United States Patent [19]

Goren et al.

[11] 4,003,649

[45] Jan. 18, 1977

[54] ELECTROPHOTOGRAPHIC HALFTONE PRINTING MACHINE EMPLOYING A PHASE SCREEN

[75] Inventors: Robert Nathan Goren, Rochester, N.Y.; William Streifer, Palo Alto, Calif.; Lawrence Morton Marks, Mississauga, Canada

[73] Assignee: Xerox Corporation, Stamford, Conn.

[22] Filed: Mar. 7, 1975

[21] Appl. No.: 556,387

[52] U.S. Cl. ..... 355/4; 355/32

[51] Int. Cl.[2] ..... G03G 15/01

[58] Field of Search ..... 355/4, 3 R, 18, 32, 355/53, 71; 96/45

[56] References Cited

UNITED STATES PATENTS

| | | | |
|---|---|---|---|
| 2,598,732 | 6/1952 | Walkup | 355/17 X |
| 3,120,790 | 2/1964 | Carlson et al. | 96/45 X |
| 3,152,528 | 10/1964 | Pendry | 355/3 R |
| 3,212,889 | 10/1965 | Gundlach et al. | 96/45 X |
| 3,248,216 | 4/1966 | Weigl | 355/3 R |
| 3,337,339 | 8/1967 | Snelling | 355/3 R |
| 3,497,296 | 2/1970 | Faw | 355/3 R |
| 3,535,036 | 10/1970 | Starkweather | 355/3 R |
| 3,540,806 | 11/1970 | Starkweather | 355/3 R |
| 3,914,040 | 10/1975 | McVeigh | 96/45 X |

*Primary Examiner*—R. L. Moses
*Attorney, Agent, or Firm*—H. Fleischer; J. J. Ralabate; C. A. Green

[57] ABSTRACT

Apparatus for optically imaging a halftone pattern on a xerographic photoreceptor to produce color copies of a color original. The apparatus includes a phase screen for providing a predetermined halftone pattern, the screen producing substantially the same pattern at the same spatial frequency over the visible light spectrum.

22 Claims, 15 Drawing Figures

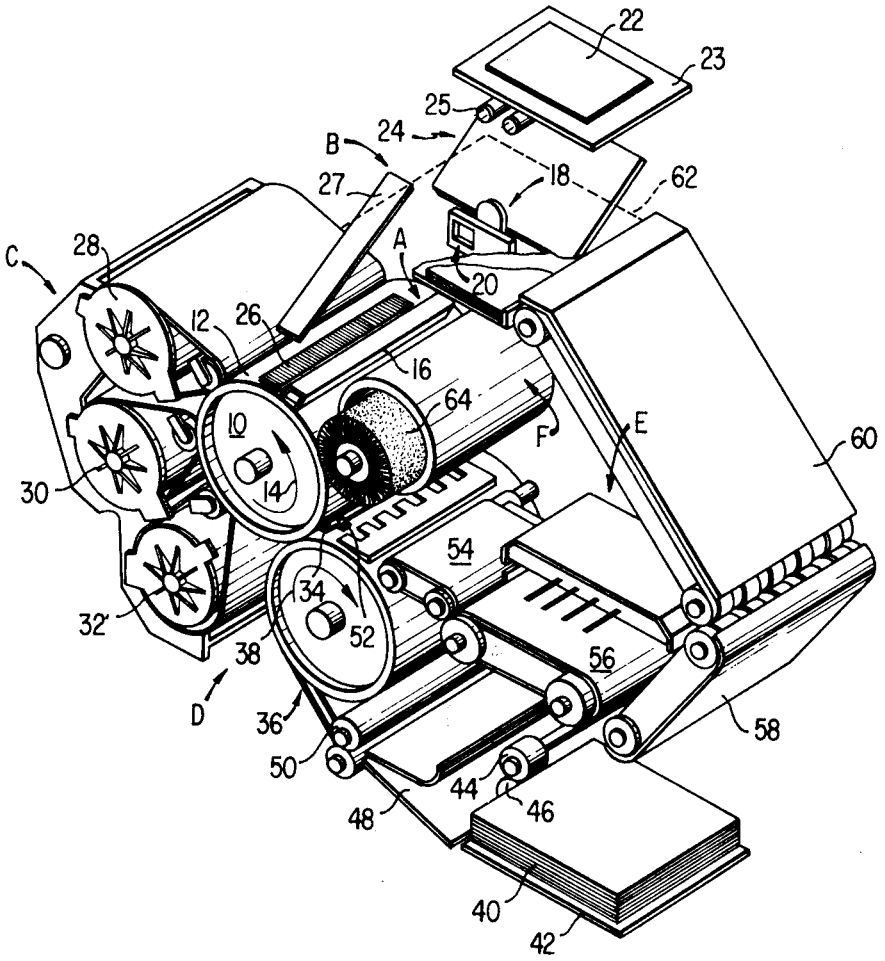
FIG. 1
FIG. 3a
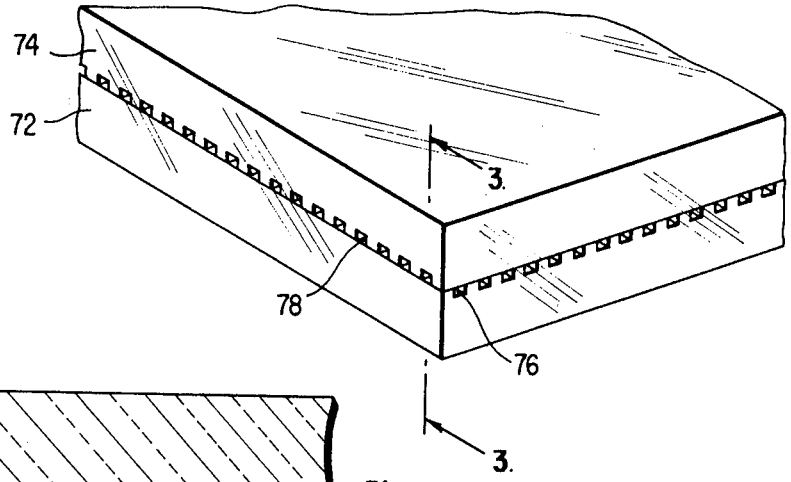
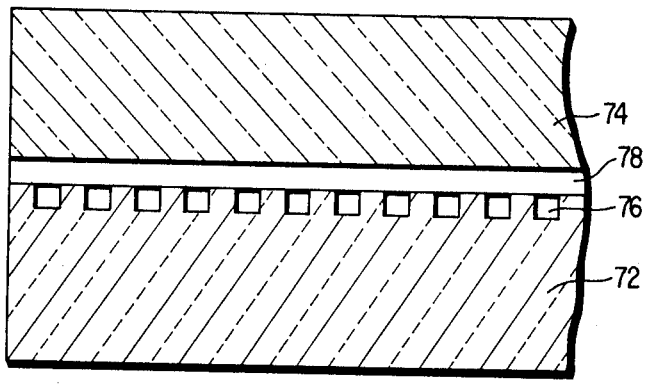
FIG. 3b

ELECTROPHOTOGRAPHIC HALFTONE PRINTING MACHINE EMPLOYING A PHASE SCREEN

This invention relates to halftone reproductions in which color halftone patterns are imaged on a photosensitive member and, in particular, to xerography in which color halftone patterns are imaged on a xerographic photoreceptor.

Halftone screens are known in the graphic arts including the xerographic reproduction art for improving continuous tone reproduction by resolving the original image into a particular halftone pattern such as lines or dots. Basically, there are two types of screens; those that work in contact with a photosensitive surface and those that are spaced some distance away from such surface. The former type contains a built-in, smoothly modulated, variation in transmission corresponding exactly to the intensity modulation at the photosensitive surface required to produce the halftone image. The latter type customarily includes absorbing rulings which depend on both absorption and diffraction of light to produce the desired smoothly modulated light pattern. This latter type produces the desired light pattern at a distance behind the rulings.

The screen having the absorbing rulings resembles a transmission grating and is constructed by ruling straight grooves at the desired frequency, typically 24–80 lines/cm. in glass or plastic. The grooves are filled with an opaque material and by varying the width of the rulings or modulating the absorption across a ruling different screens of this type can be produced.

More recently, a ruled screen which only phase shifts and diffracts an incoming light wave, i.e. absorbs substantially no radiation, has been developed by Max Levy & Company, Inc., Philadelphia, Pennsylvania. The applicants have determined that with modifications to this screen, it can be used in a color halftone pattern reproduction system to produce a desired halftone pattern with the screen spaced from the photosensitive member.

The more recently developed screen, hereinafter called a "phase screen", includes grooves cut in a non-absorbing transparent material and having a depth in the order of the wavelength of light, the grooves being filled with air. Whereas the screen having absorbing rulings periodically absorbs light from incoming radiation, the phase screen periodically phase shifts the incoming radiation. One significant advantage of the phase screen is that it does not absorb any light passing through it. Consequently, a shorter exposure time or smaller light source is required when producing a halftone pattern with a phase screen.

The particular phase screen known to the applicant and developed by Max Levy & Company, Inc. is composed of two plates of glass, each ruled with straight, square cut grooves 0.67 $\mu$ deep, 60 lines/cm, with the groove width equal to ½ the screen period. These plates are positioned with rulings touching each other and aligned orthogonally. Light passing through air in the groove is phase shifted with respect to light passing only through glass by an angle of $2\pi (n_g - n_a) t/\lambda$ where $n_g$ = index of refraction of glass, $n_a$ = index of refraction of air = 1, $t$ is the groove depth and $\lambda$ is the wavelength of light.

The applicants have performed extensive experimental and analytic work to understand how a phase screen works. As shown in an article entitled Analysis and Experimental Study of Ruled Halftone Screens, by W. Streifer, R. Goren, and L. Marks, Applied Optics, Vol. 13, No. 5, page 1299, June 1974, which is incorporated by reference herein, the light intensity distribution for phase screens has been calculated. The formulas, which are derived from the theory of partial coherence, include diffraction effects at both the lens aperture used in the optical system and the phase screen. Theoretical predictions for the particular phase screen mentioned above and a variety of circular apertures, wavelengths of light, and screen spacings from an image plane were shown to agree very well with the experimentally measured intensity patterns.

From these calculations and experiments the applicants have determined that the intensity pattern produced by the above-noted phase screen having the 0.67 $\lambda$ deep square cut rulings is strongly dependent on the wavelength of the incoming radiation. These rulings will produce approximately a 270° relative phase shift when illuminated with 450 nanometers (nm) blue light resulting in a halftone pattern at the ruling or screen frequency. For a relative phase shift of 180° produced with 670 nm red light, there will result a similar halftone pattern as that produced by the 270° relative phase shift, but at twice the screen frequency. Other relative phase shifts will produce unusually shaped halftone patterns different from the above, but within approximately 20° of the above special cases of 270° and 180° relative phase shifts, the patterns are essentially unchanged.

The use of such a particular phase screen, though advantageous in view of its non-absorbing light characteristics, is disadvantageous in a multi-color electrophotographic or photographic printing process due to its wavelength dependency. For example, in multicolor electrophotographic printing, a photoconductive surface is uniformly charged and then exposed to a light image of the colored original. Rather than forming a total light image of the original, as in black and white reproduction, the light image is filtered by a light filter, thereby producing a single color light image which is a partial light image of the original. The foregoing single color light image exposes the charged photoconductive surface to record thereon a single color electrostatic image. This single color electrostatic latent image is then rendered visible, i.e., developed, by depositing thereon toner particles, of a color complementary to the single color light image, which adhere to the photoconductive surface in image configuration. Thereafter, the single color toner powder image is transferred to a sheet of support material which may be plain paper or a transparent thermoplastic material amongst others. The foregoing process is repeated for a plurality of cycles with different color light images and the respective complementary color toner particles. Each single color toner powder image is transferred to the support material in superimposed registration with the prior toner powder image to form a composite multipowder image thereon. This multi-color powder image is then coalesced and permanently affixed to the support material, thereby providing a color copy of the original document.

It is apparent that in a multi-color electrophotographic printing process if color halftone patterns are desired, the screen should produce subtantially the same intensity pattern irrespective of the wavelength of light illuminating the screen. In the above-described multi-color printing process, if the wavelength dependent phase screen is positioned between the photoconductive surface and the light filter, then a different electrostatic intensity pattern will be produced on the photoconductive surface for each partial light image. For example, if blue light is transmitted by the filter during exposure of one cycle then such phase screen will produce an electrostatic halftone pattern at the screen frequency, whereas if red light is transmitted during the exposure of a second cycle an electrostatic halftone pattern at twice the screen frequency will be produced. Consequently, the electrostatic charge pattern developed for each cycle of the color process will produce different powdered halftone patterns, resulting in a poor quality copy.

It is an object of this invention to improve the methods and apparatus for making color copies of original documents.

Another object of the present invention is to provide a xerographic copying machine and process employing a phase screen for making color halftone copies.

Yet another object of the present invention is to provide an improved phase screen.

A still further object of this invention is to provide a phase screen which produces a halftone pattern substantially independent of the wavelength of incident radiation over an extended range of wavelength of light.

A further object of the present invention is to provide a phase screen which produces substantially the same intensity pattern at the same spatial frequency over the visible spectrum.

Briefly stated, and in accordance with the present invention, the applicants have found that a phase screen having a ruling of a particular depth will provide substantially the same intensity pattern at the same spatial frequency over an extended wavelength range, particularly over the visible region. Consequently, these and other objects of the present invention are achieved by generating an electrostatic halftone pattern on a photoconductive surface by exposing this surface to light through such phase screen.

For a better understanding of the invention as well as other objects and further features thereof, reference is made to the following detailed description of the invention to be read in connection with the accompanying drawings, in which:

FIG. 1 is a schematic perspective view of an electrophotographic printing machine having the present invention therein:

FIG. 2(*b*) is a cross section along line 2—2 of FIG. 2(*a*).

FIG. 3(*a*) is a fragmentary perspective of another embodiment of a phase screen of the present invention for use in another printing machine;

FIG. 3(*b*) is a cross section along line 3—3 of FIG. 3(*a*).

Figure 4A:
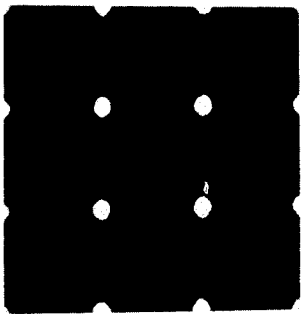
Figure 4B:
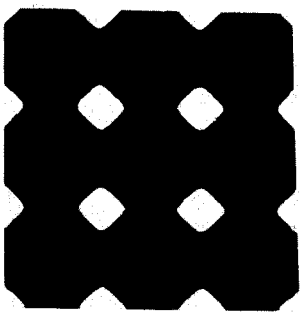
Figure 4C:
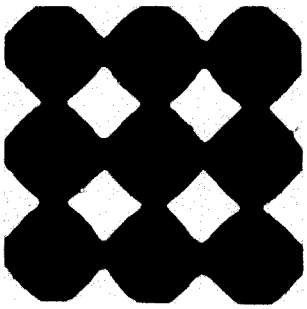

FIGS. 4(*a*)–(*c*) disclose photographically recorded isophotes of the halftone pattern produced by the phase screen of FIGS. 3(*a*), 3(*b*) for broadband red illumination.

Figure 5A:
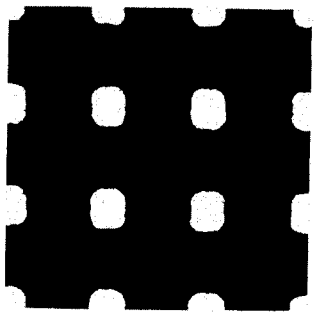
Figure 5B:
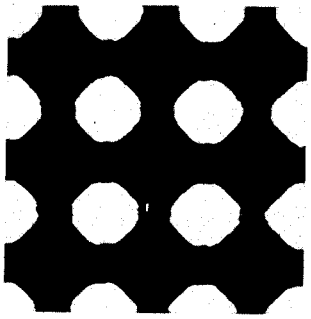
Figure 5C:
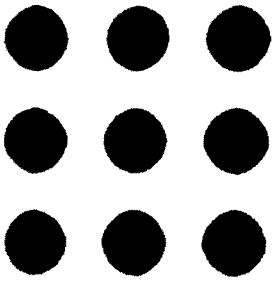
Figure 6A:
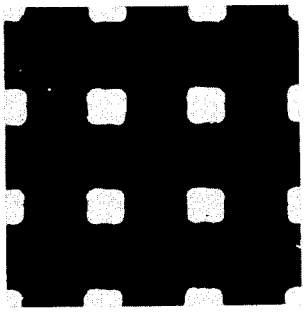
Figure 6B:
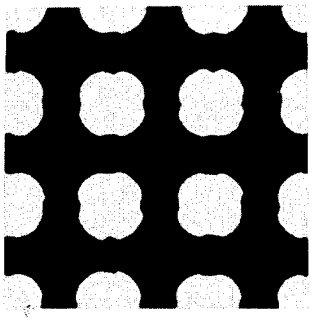
Figure 6C:
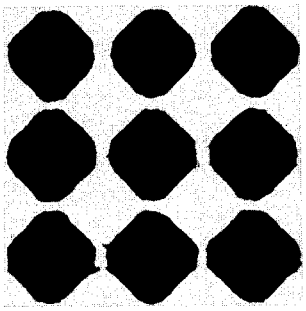
Figure 6D:
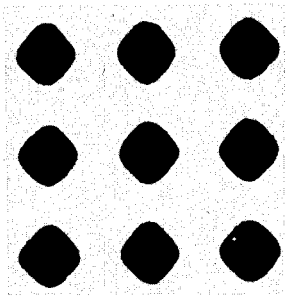

FIGS. 5(*a*)–(*c*) disclose photographically recorded isophotes of the halftone pattern produced by the phase screen of FIGS. 3(*a*), 3(*b*) for broadband green illumination.

FIGS. 6(*a*)–(*d*) illustrate photographically recorded isophotes of the halftone pattern produced by the phase screen of FIGS. 3(*a*), 3(*b*) for broadband blue illumination.

FIG. 1 schematically illustrates the components of an electrophotographic printing machine for producing multi-color copies from a colored original. As shown in FIG. 1, the electrophotographic printing machine includes a rotatably mounted drum 10 having a photoconductive surface 12 thereon. Drum 10 is mounted on a shaft journaled in the printing machine frame to rotate in the direction indicated by arrow 14 causing photoconductive surface 12 to pass sequentially through processing stations A through F, inclusive.

Initially drum 10 rotates in the direction of arrow 14 to move photoconductive surface 12 through charging station A. Charging station A has positioned thereat a corona generating device indicated generally at 16. As illustrated in FIG. 1, corona generating device 16 is arranged to extend in a generally transverse direction across photoconductive surface 12 and charges photoconductive surface 12 to a relatively high substantially uniform potential. U.S. Pat. No. 2,778,946 issued to Mayo in 1957 describes a typical corona generating device which may be suitable for use in a multi-color electrophotographic printing machine.

After photoconductive surface 12 is charged to a substantially uniform potential, drum 10 rotates to exposure station B. At exposure station B, photoconductive surface 12 is exposed to a single color light image of the original document. A moving lens system generally designated by the reference numeral 18, and a color filter mechanism, shown generally at 20 are positioned at exposure station B. One type of moving lens system suitable for the electrostatographic printing machine of FIG. 1 is disclosed in U.S. Pat. No. 3,062,108 issued to Mayo in 1962. Original document 22 is supported in a stationary manner on transparent viewing platen 23. The lamp assembly, indicated generally at 24 and shown more specifically in U.S. Pat. No. 3,779,640, issued to Kidd in 1973, includes a pair of lamps 25, associated with lens system 18. Lamps 25 move in a timed relation with drum 10 to scan successive incremental areas of original document 22 positioned on platen 23, thereby creating a flowing light image of original 22.

Exposure station B also includes one particular embodiment of a phase screen 26, spaced above photoconductive surface 12 and between surface 12 and a reflector 27. Phase screen 26 extends in a generally transverse direction across surface 12 and has its longitudinal axis parallel to the axis of drum 10. During the exposure process, filter mechanism 20 interposes selected colored filters into the optical light path of lens 18. The filter transmits light rays of a particular color to reflector 27 which reflects these rays onto phase screen 26. The latter relatively phase shifts the reflected light rays which are used to record a single color electrostatic latent image on photoconductive surface 12 corresponding to a preselected spectral region of the electromagnetic wave spectrum (provided by the filter) and thereby create the halftone pattern.

After the single color electrostatic latent image is recorded on photoconductive surface 12, drum 10 rotates to development station C. Development station C includes three individual developer units, generally indicated by the reference numerals 28, 30 and 32, respectively. A suitable development system utilizing a plurality of developer units is disclosed in copending application Ser. No. 255,259 filed in 1972. As disclosed in the foregoing patent application, the developer units may be magnetic brush developer units. Typical magnetic brush developer units utilize a magnetizable developer mix including carrier granules and toner particles. This developer mix is brought continuously through a directional flux field to form a brush thereof. Development is achieved by bringing the single color electrostatic latent image recorded on photoconductive surface 12 into contact with the brush of developer mix. Differently colored toner particles corresponding to the complement of the spectral region of the wavelength of light transmitted through filter 20 are contained within each of the respective developer units. For example, a green filtered electrostatic image is made visible by depositing green absorbing magenta toner particles thereon. Similarly, blue and red latent halftone images are developed with yellow and cyan toner particles respectively.

Subsequent to the formation of the toner powder image on photoconductive surface 12, drum 10 is rotated to transfer station D. At transfer station D, the powder image adhering electrostatically to photoconductive surface 12 is transferred to a sheet of final support material 34. Final support material 34 may be plain or, in the formation of transparencies, a thermoplastic transparent material. A bias transfer roll, shown generally at 36, recirculates support material 34 in the direction of arrow 38. Roll 36 is electrically biased to a potential of sufficient magnitude and polarity to electrostatically attract toner particles from photoconductive surface 12 to sheet 34. U.S. Pat. No. 3,612,677 issued to Langdon in 1972 discloses a suitable electrically biased transfer roll. Transfer roll 36 is arranged to rotate in synchronism with photoconductive surface 12, i.e., transfer roll 36 and drum 10 rotate substantially at the same speed and have substantially the same outer diameter. Inasmuch as support material 34 is secured releasably to transfer roll 36 for movement therewith in a recirculating path, successive toner powder images may be transferred thereto. Hence, successively colored toner particles are transferred from photoconductive surface 12 to support material 34 is superimposed registration with one another. In this way, a multi-colored toner powder image corresponding to the colors found in the original document is formed on support material 34.

With continued reference to FIG. 1, the paper path for advancing support material 34 to transfer roll 36 will hereinafter be described. Stack 40 of support material 34 is supported on tray 42. Feed roll 44 operatively associated with retard roll 46 separates and advances the uppermost sheet from stack 40. The advancing sheet moves into paper chute 48 and is directed into the nip of register rolls 50. Next; gripper fingers 52 mounted on transfer roll 36 releasably secure thereto support material 34 for movement therewith in a recirculating path.

After all of the discretely colored powder images have been transferred to support material 34, support material 34 is stripped from transfer roll 36 and moved on endless belt conveyor 54 to fixing station E, where a fuser indicated generally at 56, coalesces and permanently affixed the transferred powder image to sheet 34. A typical fuser is described in U.S. Pat. No. 3,498,592 issued to Moser et al in 1970. After the powder image is fused, support material 34 is advanced by endless belt conveyors 58 and 60 to catch tray 62. At catch tray 62, an operator may remove the final multi-color copy from the machine.

As indicated by arrow 14, the final process in the direction of rotation of drum 10 is cleaning station F. Brush cleaning device 64 positioned at cleaning station F, may be of the type described in U.S. Pat. No. 3,590,412 issued to Gerbasi in 1971. As disclosed therein, a rotatably mounted fibrous brush is maintained in contact with photoconductive surface 12 to remove residual toner particles remaining thereon after each transfer operation.

Figure 2A:
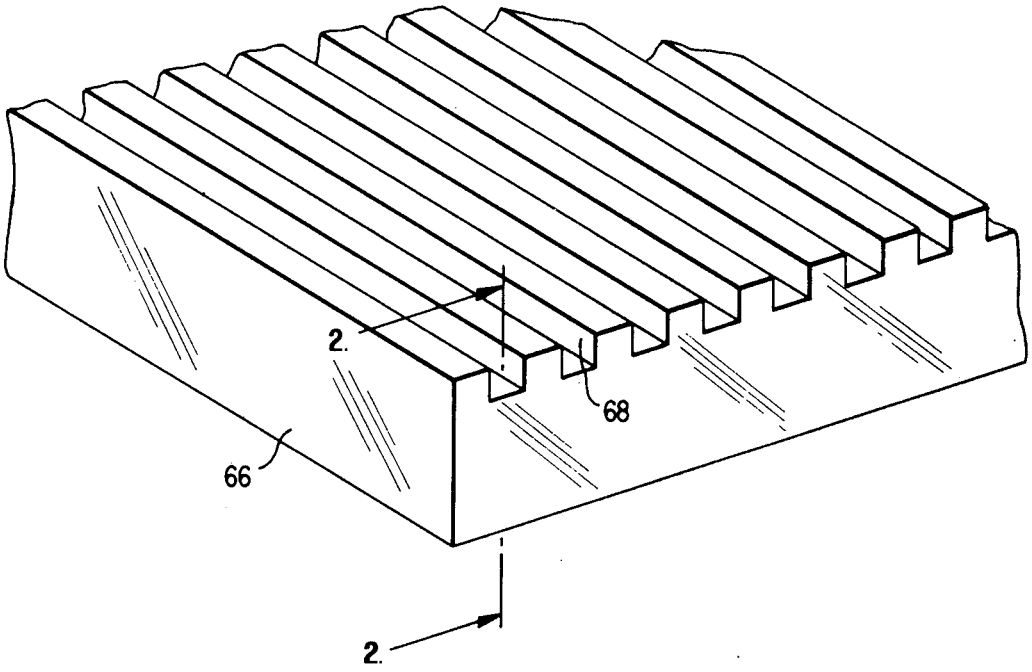
FIG. 2(*a*) is a fragmentary perspective of one embodiment of a phase screen of the present invention incorporated in the FIG. 1 printing machine.
Figure 2B:
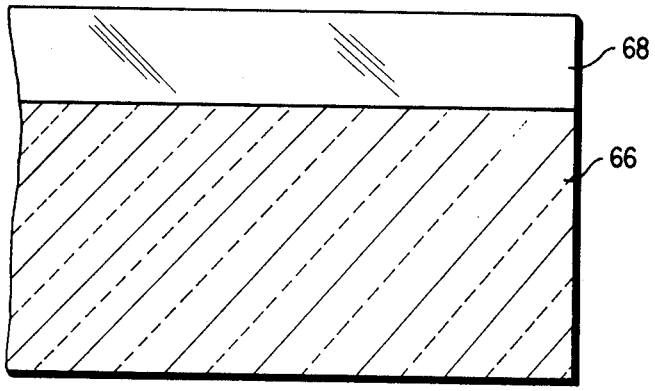

FIGS. 2(*a*), 2(*b*) illustrate phase screen 26 which may be used in a printing machine having a scanning imaging system of the type shown in FIG. 1. The phase screen 26 includes a substrate 66 made of a non-absorbing transparent material such as glass or plastic. A plurality of square cut rulings or grooves 68 of a predetermined screen frequency extend in straight lines across substrate 66. Phase screen 26 is positioned above surface 12 such that the rulings 68 are aligned parallel to the direction of rotation and orthogonal to the axis of drum 10.

Each of the grooves 68 is 0.25 $\mu$ deep and filled with air, the thickness of substrate 66 being about 0.1 inch. With this depth for the grooves 68, phase screen 26 will provide a relative phase shift of about 90° for light in the center of the visible spectrum. That is, light whose wavelength is in the center of the visible spectrum and passes only through, for example, the glass of screen 26 will be phase shifted about 90° with respect to such light which is transmitted through both the glass and the air in groove 68. Such a phase shift 26 will produce an intensity modulated light pattern which produces an electrostatic halftone pattern on photoconductive surface 12 of a particular geometry. Moreover, this phase screen 26 will provide an interference pattern on the photoconductive surface 12 of substantially the same shape at the same spatial frequency over the visible wavelength region of 400 to 700 nm.

FIGS. 3(*a*), 3(*b*) show an alternative embodiment for the phase screen of the present invention. Whereas phase screen 26 produces a one dimensional line halftone pattern due to the aligned grooves 68, the other embodiment of the phase screen provides a two dimensional dot shaped pattern. As illustrated, this alternative structure comprises a phase screen 70 having two substrates, 72, 74 of a non-absorbing transparent material such as glass or plastic. Each substrate 72, 74 includes a plurality of square cut rulings or grooves 76, 78, respectively, of a predetermined frequency extending in straight lines across the respective substrate. Substrates 72, 74 are sandwiched together with the grooves 76, 78 touching and aligned orthogonally to form a crossline screen, which produces the two dimensional dot pattern.

As may be seen, phase screen 70 comprises two phase screens 26 sandwiched together as described. Consequently, each of the grooves 76, 78 is 0.25 $\mu$ deep and filled with air, the thickness of each substrate 72, 74 being about 0.1 inch. Phase screen 70 also provides a relative phase shift of about 90° for light in the center of the visible spectrum, as with phase screen 26. The dot pattern produced by screen 70 is substantially the same and occurs at the same spatial frequency over the visible wavelength region of about 400 to 700 nm.

As noted above, phase screen 26 may be used in a printing machine having a scanning imaging system as shown in FIG. 1 to provide the desired intensity pattern. However, phase screen 70 should not be used with such a scanning system, but should be used in a printing machine incorporating an imaging system in which light imaging rays of the original are flashed full frame on a photosensitive member. The latter type of imaging system is known as disclosed in the U.S. Pat. No. 3,734,607 of Davis et al, issued May 22, 1973. Phase screen 70 would be positioned between the photoconductive belt assembly 13 and filter drive 25 shown in this patent, and spaced above the former. If phase screen 70 were used with the scanning imaging system shown in FIG. 1, due to the flowing light image there would result on surface 12 a dot pattern in which at least several of the dots would be misshapen with respect to the other dots. This problem is avoided if phase screen 70 is used in a full frame flash type imaging system in which there is no flowing light image.

The relative phase shift produced by phase screens 26, 70 varies from 65°–115°, i.e., 90°±25° across the visible spectrum. such variation will result in the production of a halftone pattern which is not identical to the pattern produced with the 90° relative phase shift; however, the patterns produced over the phase shift range of 65°–115° will be substantially the same in geometry to produce a quality color copy of a color original document, and will have the same spatial frequency. Furthermore, the depth of the rulings filled with air may range from 0.23 $\mu$ to 0.27 $\mu$and still provide line and dot half-tone patterns which are substantially the same and at the same spatial frequency across the visible spectrum.

As will now be described, there are additional modifications which may be made to both phase screens 26, 70 to provide the same intensity pattern across the visible spectrum. It may be noted from the formula given above for the relative phase shift of light through the phase screen, i.e., $2\pi\ (n_g - n_a)\ t/\lambda$ that it is the product $(n_g - n_a)t$ which must remain substantially the same to generate the required phase shift in the specific embodiments given above. If glass and air filled grooves are used in the phase screens, then $t$ is about 0.25 $\mu$, with $n_g = 1.5$ and $n = 1$. However, if the absolute tolerance on the depth of the recommended 0.25 $\mu$rulings causes fabrication difficulty, then the depth of the rulings may be increased provided the rulings are filled with fluid whose index of refraction $n_f$ is closer to glass. That is, in the above formula, $n_a$ would be replaced by $n_f$. Thus, the difference $n_g - n_f$ would be smaller than the difference $n_g - n_a$, but t may be increased. Generally, therefore, assuming that the term $n_g$ is replaced by $n_s$ (index of refraction of the substrate), it may be seen that various nonabsorbing transparent materials may be used for substrates 66, 72, 74, together with various fluids filling the rulings 68, 76, 78 and ruling depths. The particular combination of substrate material, fluid and ruling depth must be such as to produce a relative phase shift of 90° ± 25°.

The grooves in phase screens 26, 70 will have a predetermined screen frequency as mentioned above. Typically, the groove width will be equal to 50% of the screen periodicity; however, the grooves may be cut to other percentages of the screen periodicity. This variation in ruling width will change the dependence of the resulting halftone pattern on exposure, but not the light wavelength dependence of the pattern. Furthermore, the grooves may be cut with curved bottoms, rather than square cut, without substantially changing the shape of spatial frequency of the halftone pattern.

As already described, phase screen 26 or phase screen 70 will produce substantially the same halftone pattern at the same spatial frequency over an extended range of wavelengths of light. However, the particular one dimensional or two dimensional pattern produced depends on the spacing of the screen from the photoconductive surface, the effective exposure and the effective lens aperture or $f$ number of the lens used in the imaging system shown in FIG. 1 or the full frame flash system disclosed in the above mentioned patent to Davis et al. The effective exposure, as is known, is dependent on the intensity of the illumination lamp, the time of exposure and the sensitivity of the photosensitive surface such as surface 12 over the wavelength of illumination received by such surface. The effective $f$ number is conventionally defined as $(m+1)\ f$ where m is magnification and $f$ the $f$ number of the lens.

As is known, a halftone pattern of dots provides the highest quality image. Such a dot pattern may be produced by the phase screen 70 in which the rulings are made in glass, the thickness of each of the substrates is 0.1 inch and the surface of the screen facing the photosensitive member is about 0.300 inch above such surface, i.e., the photoconductive belt in the patent to Davis et al. A suitable dot pattern may be obtained in a range of effective $f$ numbers of 45–300, preferably 100–150, with the spacing of the screen from the photosensitive member increasing with effective f number.

FIGS. 4(*a*) – (*c*) disclose photographically recorded isophotes of the intensity of halftone pattern produced by the phase screen 70 spaced 0.300 inch from the photosensitive surface for broadband red illumination. The photographs in each of these figures show the isophotes for different values of exposure that decrease from (*a*) to (*c*). FIGS. 5(*a*)–(*c*) illustrate photographically recorded isophotes of the halftone pattern produced by this phase screen for broadband green illumination, with decreasing exposure from (*a*) to (*c*). FIGS. 6(*a*)–(*d*) also depict photographically recorded isophotes of the intensity pattern of such phase screen for broadband blue illumination, with decreasing exposure from (*a*) to (*d*).

These photographs illustrate that with the phase screen of the present invention, a two dimensional halftone pattern having the same spatial frequency and substantially the same dot shapes may be obtained for broadband red, green and blue illumination, as would be used in a xerographic color copying machine. Also, these photographs show that only conventional halftone patterns may be produced over such red, green and blue illumination, the particular pattern being dependent on the effective exposure, $f$ number and screen spacing used, as described above.

The photographs were made with a Simmons Omega model enlarger D3 equipped with a Xenomega PXA light source. Interchangeable Kodak Wratten Color filters 2961 and 47B were used to provide illumination with broadband red, green and blue light, together with Kodalith Ortho (blue, green light) and Pan (red light) film. The enlarger included a Schneider Componon 135 mm lens, and exposure times for red, green and blue light were, respectively, about ½ second, 4 seconds and 7 seconds. A Kodak neutral density step wedge was placed over the film to enable several varying exposures to be obtained as shown in the figures. The photographs were made at $f$ 45 with a magnification of 1.5, thereby giving an effective exposure of about 112.

In multi-color xerography, blue, green and red light filtered by the filter system 20 may be used to produce color copies. For typical color filters this light comprises three bands centered at roughly 0.43 $\mu$, 0.51 $\mu$ and 0.62 $\mu$, respectively. In an alternative embodiment each of the grooves 68, 74, 76 which is filled with air, may be made 2.8 $\mu$ deep and thereby will provide relative phase shifts of 13°×90°, 11°×90°and 9°×90° at such wavelengths, respectively. These relative phase shifts are all equivalent to 90°; as is known, all phase shifts of $n$×90° where n is an odd integer are equivalent to 90°Thus, this particular screen is useful for producing substantially similar halftone patterns for blue, green and red light. However, for this groove depth, there is a rapid variation of relative phase shift with wavelength; consequently, such a screen would require essentially line source illumination at wavelengths within 0.01 $\mu$ of the above-noted values to keep the relative phase shifts within ± 20° of the desired multiples of 90°. This line source illumination may be provided with filters in, for example, filter system 20 which have a very narrow pass band at such values.

Also, other ruling depths within the range of 2.6 $\mu$ to 3.1 $\mu$ may be used, together with other appropriate narrow band light wavelengths given by the equation given above for the relative phase shift of light through the phase screen. This range applies when a substrate of glass and air filled grooves are used for the phase screen. However, as described earlier these ruling depths may be changed by changing the substrate index of refraction and groove fill material index of refraction in accordance with such equation.

The phase screen of the present invention has been described in detail for use in xerographic color reproduction system. However, this phase screen may be employed in any color reproduction system in which halftone patterns are produced on a photosensitive member. For example, the phase screen may be used in silver halide photographic reproduction techniques as well as photolithography.

Furthermore, the phase screen of the present invention can be used for black and white copying of a black and white or color original document. White light illuminating and reflected from a black and white original, or from a color original, will have red, green and blue components. The phase screen will modulate the intensity of the incoming white light reflected from the original document to relatively phase shift these three color components as already described. Thus, a grey scale halftone pattern will be produced in which the modulation of the three color components will tend to provide a pattern which is substantially the same at the same spatial frequency.

It is therefore evident that there has been provided, in accordance with the present invention, a halftone reproduction apparatus that fully satisfies the objects, aims and advantages set forth above. While this invention has been described in conjunction with specific embodiments thereof, variations will be apparent to those skilled in the art. Accordingly, it is intended to embrace all alternatives, modifications and variations that fall within the spirit and broad scope of the appended claims.

What is claimed is:

1. Apparatus for providing a halftone pattern on a photosensitive member comprising:

means for projecting a light image onto the photosensitive member; and a phase screen, interposed between said projecting means and the photosensitive member so that the light image passes therethrough, including a substrate having a plurality of grooves therein, said phase screen transmitting light therethrough, in which light transmitted only through the substrate is phase shifted with respect to light passing through both the grooves and the substrate, the grooves being of a preselected depth so that the light transmitted therethrough forms a halftone pattern of the light image on said photosensitive member having substantially the same spatial frequency over a predetermined extended range of wavelength of light.

2. The apparatus of claim 1 wherein said range of wavelength of light is an extended range of visible light over the range of about 400–700 nanometers.

3. The apparatus of claim 2 wherein said relative phase shift is 90°±25°.

4. The apparatus of claim 3 wherein the depth of said grooves is about 0.23 $\mu$ to 0.27 $\mu$.

5. The apparatus of claim 1 wherein the depth of said grooves is about 2.8 $\mu$.

6. The apparatus of claim 3 wherein said substrate comprises a first member and said plurality of grooves comprises a first group of grooves, said first group being located in the surface of said first member and extending in a straight line across said surface of said first member in one direction, and wherein said substrate comprises a second member and said plurality of grooves comprises a second group of grooves, said second group being located in the surface of said second member and extending in a straight line across said surface of said second member in one direction, said first and second groups of grooves touching each other and aligned orthogonally to one another.

7. The apparatus of claim 6 wherein said first and second groups of grooves are filled with air.

8. The apparatus of claim 7 wherein said first and second members are glass.

9. The apparatus of claim 7 wherein said first and second members are plastic.

10. A multi-color printing machine including:

a photosensitive member;

means for illuminating a color original document;

means for forming a light image of the color original document;

means for directing the light image of the color original document onto said photosensitive member; and a phase screen spaced a predetermined distance from said photosensitive member and positioned so that the light image of the color original document passes therethrough, said phase screen comprising a substrate having a plurality of grooves therein with the light only transmitted through the substrate being phase shifted with respect to light passing through both the grooves and the substrate and the grooves being of a preselected depth so that the light transmitted therethrough forms a halftone pattern of the light image on said photosensitive member having substantially the same spatial frequency over a predetermined extended range of wavelength of light.

11. The printing machine of claim 10 wherein said range of wavelengths of light is visible light over the range of about 400 –700 nanometers.

12. The printing machine of claim 11 wherein said relative phase shift is 90°±25°.

13. The printing machine of claim 12 wherein the depth of said grooves is about 0.23 $\mu$ to 0.27 $\mu$.

14. The printing machine of claim 13 wherein said phase screen is spaced a distance above said photosensitive member to produce a halftone dot pattern.

15. Exposure apparatus for a multi-color electrostatic copying machine for producing copies of a color original document in which electrostatic latent images are produced on a sensitized photoconductive member, comprising:

a. means for illuminating the color original document;

b. means for forming a light image of the color original document;

c. means for filtering the light image to produce successive single color light images corresponding to preselected spectral regions of the electromagnetic wave spectrum;

d. means for directing each single color light image onto the sensitized photoconductive member; and e. means, spaced apart from the photoconductive member, for receiving each single color light image and transmitting each single color light image to the photoconductive member, said receiving and transmitting means transmitting light therethrough having a halftone pattern with substantially the same spatial frequency over a predetermined extended range of wavelength of light, thereby recording successive halftone electrostatic latent images corresponding to each single color light image with each halftone electrostatic latent image being of substantially the same spatial frequency for the predetermined extended range of wavelength of light.

16. The apparatus of claim 15 wherein said extended range of wavelength of the light image is about 400–700 nanometers.

17. The apparatus of claim 16 wherein said means for receiving and transmitting comprises a phase screen having a substrate and a plurality of grooves located in said substrate, in which light passing only through the substrate is shifted in phase relative to light passing through both the grooves and the substrate.

18. The apparatus of claim 17 wherein said plurality of grooves comprises first and second groups of grooves aligned orthogonally to one another.

19. The apparatus of claim 18 wherein the depth of said grooves in said substrate is in the range of 0.23 $\mu$ to 0.27 $\mu$.

20. The apparatus of claim 18 wherein said relative phase shift is 90°± 25°.

21. The apparatus of claim 20 wherein said phase screen is spaced about 0.300 inches above said photoconductive member.

22. The apparatus of claim 21 wherein said grooves are filled with air.

* * * * *